US007768487B2

(12) United States Patent
Jeon

(10) Patent No.: US 7,768,487 B2
(45) Date of Patent: Aug. 3, 2010

(54) DRIVING SYSTEM FOR AN ELECTRO-LUMINESCENCE DISPLAY DEVICE

(75) Inventor: Chang-Hoon Jeon, Gyeongsangbuk-Do (KR)

(73) Assignee: LG. Display Co., Ltd., Seoul (KR)

( * ) Notice: Subject to any disclaimer, the term of this patent is extended or adjusted under 35 U.S.C. 154(b) by 786 days.

(21) Appl. No.: 11/207,310

(22) Filed: Aug. 19, 2005

(65) Prior Publication Data

US 2006/0145962 A1 Jul. 6, 2006

(30) Foreign Application Priority Data

Dec. 31, 2004 (KR) ..... 10-2004-0118316
Aug. 18, 2005 (KR) ..... 10-2005-0075837

(51) Int. Cl.
*G09G 3/32* (2006.01)

(52) U.S. Cl. ..... 345/82; 345/204

(58) Field of Classification Search ..... 345/601, 345/82–84, 102, 204, 207–211
See application file for complete search history.

(56) References Cited

U.S. PATENT DOCUMENTS

| | | | | |
|---|---|---|---|---|
| 6,582,980 | B2 | 6/2003 | Feldman et al. | |
| 2001/0026283 | A1 | 10/2001 | Yoshida et al. | |
| 2002/0154138 | A1 * | 10/2002 | Wada et al. | 345/600 |
| 2002/0196214 | A1 * | 12/2002 | Park et al. | 345/82 |
| 2004/0263540 | A1 | 12/2004 | Ooishi et al. | |
| 2005/0030268 | A1 * | 2/2005 | Zhang et al. | 345/83 |
| 2006/0114205 | A1 * | 6/2006 | Shen et al. | 345/88 |

FOREIGN PATENT DOCUMENTS

| | | |
|---|---|---|
| CN | 1393843 | 1/2003 |
| CN | 1514274 | 7/2004 |
| JP | 10-340063 | 12/1998 |
| JP | 2002-304155 | 10/2002 |
| JP | 2002-304156 | 10/2002 |
| JP | 2002-311898 | 10/2002 |
| JP | 2003-255900 A | 9/2003 |
| TW | 386172 B | 4/2000 |
| TW | 480879 B | 3/2002 |
| WO | 2004/021327 A1 | 3/2004 |

OTHER PUBLICATIONS

First Notification of Office Action for corresponding Chinese Patent Application Serial No. 200510123681.1, dated Dec. 28, 2007.
Office Action issued in corresponding Taiwanese Patent Application No. 094141701; issued Jun. 17, 2009.
Office Action issued in corresponding Japanese Patent Application No. 2005-358593; mailed Aug. 17, 2009.
Office Action issued in corresponding German Patent Application No. 10 2005 058 268.0; issued Nov. 17, 2009.

* cited by examiner

*Primary Examiner*—Amr Awad
*Assistant Examiner*—Liliana Cerullo
(74) *Attorney, Agent, or Firm*—Brinks Hofer Gilson & Lione

(57) ABSTRACT

A driving system for an electro-luminescence display device includes an organic light emitting diode (OLED) panel having a plurality of pixels. The pixels include a red pixel, a green pixel and a blue pixel. The driving system includes a controller and a level shift unit. The controller receives a first digital data and converts the first digital data into a second digital data for a gray scale display. The level shift unit converts the second digital signal to a data voltage and supplies the data voltage to the pixels. The level shift unit operates to provide a different source voltage to the red pixel, the green pixel and the blue pixel. The red, green and blue pixels may be independently and separately controlled.

7 Claims, 3 Drawing Sheets

| LUT-R=G=B | |
|---|---|
| DATA | R=G=B |
| 000000 | 00000000 |
| 000001 | 00000000 |
| 000010 | 00000000 |
| 000011 | 00000001 |
| 000100 | 00000001 |
| ⋮ | ⋮ |
| 111110 | 11111111 |
| 111111 | 11111111 |

| LUT-R | |
|---|---|
| DATA | R |
| 000000 | 00000000 |
| 000001 | 00000000 |
| 000010 | 00000000 |
| 000011 | 00000001 |
| 000100 | 00000001 |
| ⋮ | ⋮ |
| 111110 | 11111111 |
| 111111 | 11111111 |

| LUT-G | |
|---|---|
| DATA | G |
| 000000 | 00000000 |
| 000001 | 00000000 |
| 000010 | 00000001 |
| 000011 | 00000001 |
| 000100 | 00000001 |
| ⋮ | ⋮ |
| 111110 | 10111111 |
| 111111 | 10111111 |

| LUT-B | |
|---|---|
| DATA | B |
| 000000 | 00000000 |
| 000001 | 00000001 |
| 000010 | 00000001 |
| 000011 | 00000001 |
| 000100 | 00000001 |
| ⋮ | ⋮ |
| 111110 | 11011111 |
| 111111 | 11011111 |

| LUT-R=G=B | |
|---|---|
| DATA | R=G=B |
| 000000 | 00000000 |
| 000001 | 00000000 |
| 000010 | 00000000 |
| 000011 | 00000001 |
| 000100 | 00000001 |
| ⋮ | ⋮ |
| 111110 | 11111111 |
| 111111 | 11111111 |

DRIVING SYSTEM FOR AN ELECTRO-LUMINESCENCE DISPLAY DEVICE

This application claims the benefit of the Korean Patent Applications No. P2004-118316 filed on Dec. 31, 2004 and No. P2005-75837 filed on Aug. 18, 2005, which are hereby incorporated by references in its entirety.

BACKGROUND

1. Technical Field

The invention relates to a driving system for an electro-luminescence display device and more particularly, to a driving system for an electro-luminescence display device having an organic light emitting diode.

2. Related Art

A flat panel display device includes a liquid crystal display device, a field emission display device, a plasma display device, an electro-luminescence (EL) display device, etc. The EL display device is a self-light emitting device for emitting a fluorescent material by re-combining electrons and holes. The EL display device may be divided into an inorganic EL device which uses an inorganic compound as the fluorescent material and an organic EL device which uses an organic compound as the fluorescent material.

The EL display device may be driven at a low driving voltage 10V and has excellent recognition characteristics due to the self-light emitting. The EL display device may be thin because no backlight is needed. The EL display device may have advantages over LCD, such as a wide viewing angle, a quick response speed, etc.

The organic EL display device includes an electron injection layer, an electron transport layer, a light emitting layer, a hole transport layer and a hole injection layer, which are laminated between a cathode and an anode. In the organic EL device, when a certain voltage is applied between the anode and the cathode, electrons generated from the cathode move toward the light emitting layer through the electron injection layer and the electron transport layer. Holes move toward the light emitting layer through the hole injection layer and the hole transport layer. The electrons and the holes, which are supplied from the electron transport layer and the hole transport layer, are recombined in the light emitting layer, thereby emitting light.

The EL display device includes an organic light emitting diode (OLED) panel that a plurality of pixels is arranged in a matrix. Pixels include an EL cell such as an OLED. The OLED panel is connected to a scan driver and a data driver, which are controlled by a controller. The scan driver operates to activate a pixel and the data driver provides a driving voltage to the activated pixel. The pixel emits light in response to the driving voltage. Each pixel represents one of red (R), green (G) and blue (B) colors.

The EL display device may display an image in a gray scale. In the EL display device, each pixel is controlled to emit light or light off per frame. More specifically, each frame is divided into multiple sub-frames and the pixel emits light or lights off during the sub-frames in response to each bit of a digital data signal. For example, for a 12 bit digital data signal, a frame is divided into 12 sub-frames. The light emitting time of the pixel during each sub-frame is summed and represents a desired gray scale of an image.

For a gray scale display, a digital data is converted into another digital data based on a look up table ("LUT"). The LUT is stored in a controller that drives the scan driver and the data driver of the EL display device. The digital data signal is input to the controller. The controller may have a multiplexer that receives the digital data signal and determines that the digital data signal corresponds to a red (R) signal, a green (G) signal or a blue (B) signal. The controller may include three separate LUTs that are used with the R signal, the G signal and the B signal, respectively.

FIG. 1 illustrates three LUTs for use with the R, G and B data signals. Each LUT has a plurality of index values that corresponds to different digital data signals. As shown in FIG. 1, LUT-R, LUT-G and LUT-B have different index values in response to different digital data signals. For example, when a 6 bit digital data signal is 111110, LUT-R has an index value of 11111111, LUT-G has an index value of 10111111 and LUT-B has an index value of 11011111. The LUTs may not only convert the value of the digital data signal but also convert a bit number of the digital data signal. Specifically, when a 6 bit digital data signal is input to the controller and processed through the LUT, an 8 bit digital data signal having a different bit stream is output from the controller. This 8 bit digital data signal is supplied to the data driver. The bit number of the digital data signal is expanded to perform a gamma control and display a desired gray scale.

The EL display device may use the different LUTs for the R, G and B signals to achieve color coordinates, a gamma control and a contrast ratio. In the OLED panel, color pixels such as a red (R) pixel, a green (G) pixel and a blue (B) pixel may have a different efficiency. The different LUTs having different index values for the R, G and B signals may compensate for the difference in the R, G and B pixels. Upon application of the same source voltage VDD, however, the R pixel, the G pixel and the B pixel may not represent a desired gray scale image. When the same source voltage is applied to a driving transistor of the R pixel, the G pixel and the B pixel, a different color response may develop in R, G and B pixels. The source voltage VDD and the LUTs may be predetermined and uncontrollable once the EL display device is in operation.

Further, the EL display device displays an image with a full white brightness level, regardless of an ambient environment. As noted above, the source voltage VDD is preset and may not be changed in response to the ambient environment. Power consumption may increase. Therefore, there is a need of a driving system for an EL display device that obviates drawbacks of a driving method of the related art EL display device.

SUMMARY

By way of introduction only, in one embodiment, a driving system for an electro-luminescence display device is provided. The driving system includes an organic light emitting diode (OLED) panel, a controller and a level shift unit. The OLED panel includes a plurality of pixels that has a red pixel, a green pixel and a blue pixel. The controller receives a first digital data and converts the first digital data into a second digital data for a gray scale display. The level shift unit converts the second digital signal to a data voltage and supplies the data voltage to the pixels. The left shift unit is operable to provide a different source voltage to the red pixel, the green pixel and the blue pixel, respectively.

In other embodiment, a method for driving an OLED is provided. An analog data is converted to a first digital data. The first digital data is converted to a second digital data for a gray scale display. A plurality of pixels is activated in sequence in response to the second digital data. The second digital data is converted to a data voltage. The data voltage is supplied to the plurality of pixels. The pixels include a red pixel, a green pixel and a blue pixel. A different source voltage is supplied to the red pixel, the green pixel and the blue pixel.

The foregoing and other objects, features, aspects and advantages of the invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figures 1, 2:
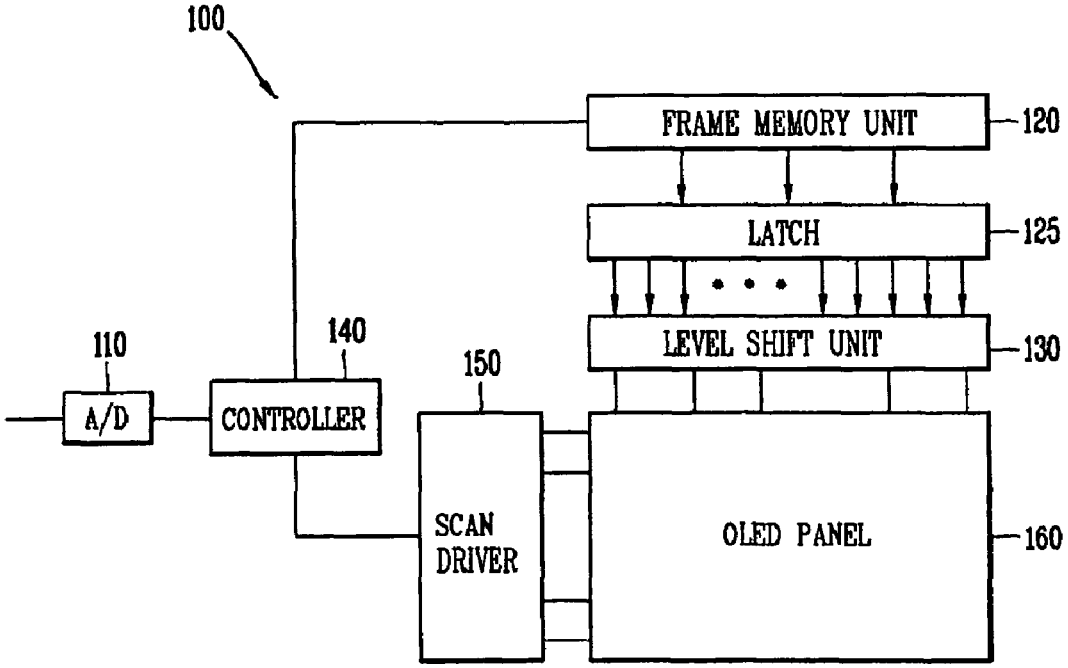
FIG. 1 RELATED ART
FIG. 1 illustrates a related art Look Up Tables for use with R, G and B color data signals.
FIG. 2 is a block diagram of an EL display device according to one embodiment.

FIG. 2 illustrates an example EL display device 100 that includes an OLED panel 160. The OLED panel 160 includes a plurality of pixels. A pixel may represent R color, G color or B color. The pixel may include an organic light emitting diode that emits a red light, a green light or a blue light to represent R, G or B color. A scan driver 150 and a level shift unit 130 are connected to the OLED panel 160 and drive the OLED panel 160. The scan driver 150 activates the pixels in sequence and the level shift unit 130 provides a respective data voltage to the pixels. The pixels emit light corresponding to the respective data voltage. The EL display device 100 also includes a controller 140. An analog-to-digital converter 110 is connected to the controller 140 and converts an analog data to a digital data. The digital data is provided to the controller 140.

The controller 140 provides the data to a frame memory unit 120 and the scan driver 150. The frame memory unit 120 passes the data to a latch 125. The latch 125 holds the data to the extent that it latches data corresponding to a number of pixels per each row of the OLED panel 160. Then, the latch 125 passes the data to the level shift unit 130 simultaneously. The R data, the G data and the B data are converted to data voltages and output from the level shift unit 130 to the pixels of the OLED panel 160. The level shift unit 130 operates to set a different source voltage depending on the R data, the G data and the B data, respectively, as will be described in detail below.

The EL display device 100 includes an optical sensor 170 that is connected to the controller 140. The optical sensor 170 senses a brightness level in an ambient environment. The controller 140 receives a sensing signal BS from the optical sensor 170 and supplies a control signal CS to the level shift unit 130. Depending on the control signal CS, the level shift unit 130 may supply a high source voltage or a low source voltage. When the EL display device 100 operates in a bright environment, the high source voltage may be provided. On the other hand, when the EL display device 100 operates in a relatively dark environment, the low source voltage may be provided.

Figure 3:
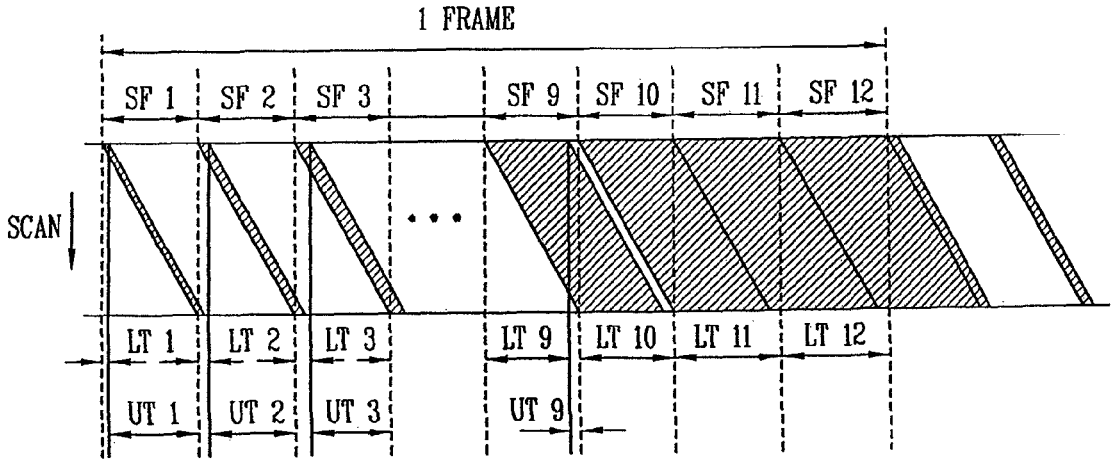
FIG. 3 is a timing diagram of a digital driving of the EL display device of FIG. 2.

FIG. 3 illustrates a digital driving method of the EL display device 100 to express a gray scale of the digital data signal. Each frame is divided into a plurality of sub-frames (SF) corresponding to each bit of a digital data signal. By way of example only, a 12-bit data signal is expressed by 256 gray scales, and one frame is divided into 12 sub-frames (SF1 to SF12) that correspond to the 12-bit digital data signal.

The first sub-frame SF1 of the 12 sub-frames (SF1 to SF12) corresponds to the least significant bit (LSB) of the digital data signal, while the 12th sub-frame (SF12) corresponds to the most significant bit (MSB) of the digital data signal. Each of the 12 sub-frames (SF1 to SF12) is divided into the light emitting time (LT1 to LT12) and the non-light emitting time (UT1 to UT12). The light emitting time (LT1 to LT12) of each sub-frame (SF1 to SF12) may use a certain code for expressing the 12-bit digital data signal in $2^8$ (=256) gray scales. For example, the code may be a binary code with a rate of 1:2:4:8:16:32 . . . or a non-binary code with a rate of 1:2:4:6:10:14:19 . . . .

During each sub-frame (SF1 to SF12) period, the EL display device emits light by sequentially scanning the entire pixels in a vertical direction, for example, from the upper portion of the OLED panel to the lower portion by the scan driver 150. Each light emitting time (LT1 to LT12) of each sub-frame period (SF1 to SF12) follows slant lines in each sub-frame (SF1 to SF12) as shown in FIG. 3.

By adding all of the light emitting time (LT1 to LT12) within each sub-frame (SF1 to SF12) during one frame, the gray scale of a desired image may be expressed. In FIG. 3, the desired image is expressed by using the non-binary code. During the divided sub-frames, the EL display device 100 emits light from the upper side to the lower side in the V-scan (vertical) direction at each different time, and the gray scale is expressed by the sum of each light emitting time.

Figure 4:
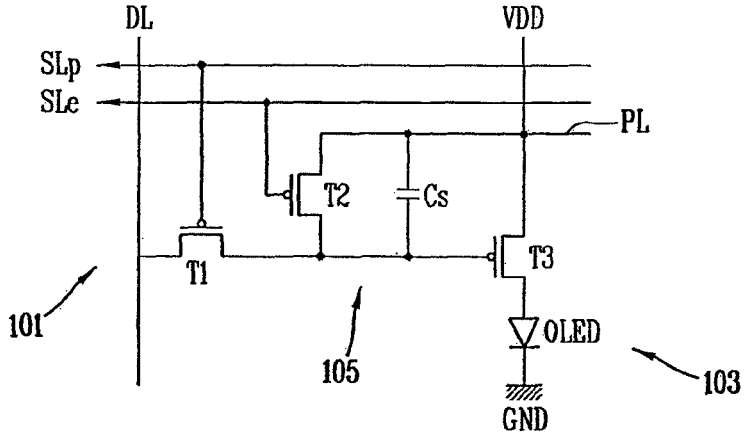
FIG. 4 illustrates a pixel having an OLED and a driving circuit.

FIG. 4 illustrates a structure of a pixel 101 for use with the organic EL display panel 100 of FIG. 2. The pixel 101 is included in the OLED panel 160. The pixel 101 emits a red light upon application of a data via a data line (DL). In other embodiments, the pixel 300 may emit a blue light or a green light. In FIG. 4, the pixel 101 includes an EL cell (OLED) 103 and a cell driving unit 105. The cell driving unit 105 includes three PMOS transistors T1, T2 and T3 for driving the EL cell 103 and a storage capacitor (Cs). The cell driving unit 105 includes the storage capacitor (Cs) connected with a power line (PL). The switching first PMOS transistor T1 is connected between a data line (DL) and the storage capacitor (Cs) and controlled by a light emitting scan line (SLp). The switching second PMOS transistor T2 is connected between the power line (PL) and the storage capacitor (Cs) and controlled by a non-light emitting scan line (SLe). A driving third PMOS transistor T3 is connected between a power line (VDD-R) and the EL cell (OLED) 103 and controlled by the storage capacitor (Cs).

The light emitting scan line (SLp) supplies a write signal, namely, a program signal (PS), for turning on the first PMOS transistor T1 during a light emitting time (LT) of each sub-frame (SF). The pixel 101 emits light during the light emitting time (LT) and lights off during a non-light emitting time (UT). The first PMOS transistor T1 is turned on by the program signal (PS) to charge a data signal in the storage capacitor (Cs), thereby turning on the third PMOS transistor T3 according to the charged voltage during the light emitting time (LT).

The non-light emitting scan line (SLe) supplies an erase signal (ES) for turning on the second PMOS transistor T2 during a non-light emitting time (UT) of each sub-frame (SF).

The second PMOS transistor T2 is turned on by the erase signal (ES) to discharge the storage capacitor (Cs), thereby turning off the third PMOS transistor T3 during the non-light emitting time (UT).

A source voltage is supplied with the power line (VDD-R). The source voltage VDR may be provided to the third transistor T3. The source voltage VDR may be a high voltage or a low voltage depending on an ambient environment. When the ambient environment is at a high brightness level, the high voltage is supplied as the source voltage VDR. On the other hand, when the ambient environment is at a low brightness level, the low voltage may be supplied as the source voltage VDR. The value of a source voltage for the pixel 101 may be different if the pixel 101 emits a green light or a blue light. Depending on whether the pixel 101 emits a red light, a green light or a blue light, a different value of a source voltage may be supplied.

The source voltage VDR is supplied to a drain terminal of the third transistor T3. The level shift unit 130 converts the digital data signal to a corresponding data voltage. The data voltage is supplied to a gate terminal of the third transistor T3. The source voltage VDR is supplied to the drain terminal of the third transistor T3. When the different source voltage may be supplied for the red pixel, the green pixel and the blue pixel, the voltage between the gate terminal and the drain terminal of the third transistor T3 may differ in the red, green and blue pixels. As a result, by supplying the different source voltage, the voltage between the gate and drain terminal of the driving transistor may be controlled and a gamma curve also may be controlled.

Figures 5, 6:
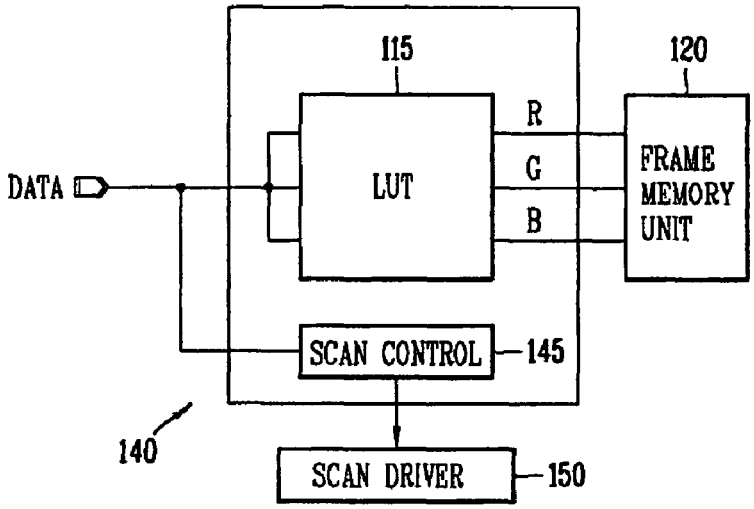
FIG. 5 illustrates a controller for use with the EL display device of FIG. 2.
FIG. 6 shows an example of an LUT included in the controller of FIG. 5.

By providing the different source voltage to the red pixel, the green pixel and the blue pixel, the gamma curve may be controlled and a desired gray scale may be displayed. Accordingly, a different look up table (LUT) for a red data signal, a green data signal and a blue data signal may not be needed. A single LUT may be used to the red, green and blue data signals. FIG. 5 illustrates a construction of the controller 140. The controller 140 includes a single LUT 115 and a scan control unit 145. The single LUT 115 is applied to the digital data signal, regardless of the red, green or blue data signal. The digital data signal is converted into a digital data signal having a different bit number to be suitable for a gray scale representation. The scan control unit 145 also receives the digital data signal and provides a control signal to the scan driver 150. The scan driver 150 supplies a data write signal and a data erase signal to control the pixels to emit light during the light emitting time and light off during the non-light emitting time, as described in conjunction with FIG. 3.

The single LUT 115 includes a plurality of index values in response to the digital data signal. FIG. 6 illustrates the LUT 115 for use with the red signal, the green signal and the blue signal. For the red, green and blue data signal of 111110, the LUT converts it to a data signal of 11111111. The converted data has an 8 bit to display a gray scale. The converted data is provided to the frame memory unit 120 and the level shift unit 130. The level shift unit 130 converts the data signal, e.g., 11111111 to a corresponding data voltage and provides it to a pixel of the OLED panel 160. The R data, the G data, or the B data is separately processed and output from the level shift unit 130. Further, the level shift unit 130 supplies the different source voltage to the red pixel, the green pixel or the blue pixel. The voltage between the gate and drain terminals of the driving transistor such as the third transistor T3 may be controlled.

Because a voltage between a gate terminal and a drain terminal of a driving transistor may be controlled to be different in the red, green or blue pixel, the gamma curve may be controlled by using the single LUT This is true even where the efficiency of the R, G and B pixel is different.

In the EL display device, a contrast ratio according to controlling of a data voltage may not be degraded. The EL display device may be able to control the gamma curve externally by using a different source voltage instead of several LUTs stored in the controller. Further, the red, green and blue pixels may be controlled separately and independently.

The above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A driving system for an electro-luminescence display device, comprising:

an organic light emitting diode (OLED) panel comprising a plurality of pixels, the pixels comprising a red pixel, a green pixel and a blue pixel;

a controller receiving a first digital data and converting the first digital data to a second digital data for a gray scale display, wherein the controller comprises:

a single look up table applied to the first digital data and storing a plurality of index values, and a scan control unit that receives the first digital data signal and provides a control signal to a scan driver, wherein the first digital data comprises a red data signal, a green data signal and a blue data signal, and the single look up table is configured to match each index value to each of the first digital data, independent of each of the first digital data being the red, green, or blue data signal such that the red, green and blue data signals having an identical bit stream are converted to an identical index value;

a frame memory unit receiving the second digital data from the controller and storing the second digital data; and a level shift unit converting the second digital signal to a data voltage and supplying the data voltage to the pixels, the level shift unit operable to determine and provide a different source voltage according to a gamma curve to the red pixel, the green pixel and the blue pixel, respectively, thereby controlling the gamma curve without a unit to generate a gamma voltage.

2. The driving system of claim 1, wherein each pixel comprises a driving transistor and the different source voltage is supplied to a drain terminal of the driving transistor and the data voltage is supplied to a gate terminal of the driving transistor.

3. The driving system of claim 1, wherein the first digital data comprises an n bit and the second digital data comprises an m bit, m being greater than n.

4. The driving system of claim 3, wherein the scan driver activates the plurality of pixels in sequence.

5. The driving system of claim 4, wherein the scan driver activates the plurality of pixels to light on and light off in response to the control signal.

6. A driving method of an electro-luminescence display device, comprising:

converting an analog data to a first digital data;

converting the first digital data to a second digital data for a gray scale display through a controller, wherein the controller comprises a single look up table applied to the first digital data and storing a plurality of index values, and a scan control unit receives the first digital data signal and provides a control signal to a scan driver, wherein converting the first digital data to the second digital data comprises applying the single look up table to match each index value to each of the first digital data, independent of each of the first digital data being the red, green, or blue data signal such that the red, green and blue data signals having an identical bit stream are converted to an identical index value;

storing the second digital data in a frame memory unit;

activating a plurality of pixels in sequence in response to the second digital data;

converting the second digital data to a data voltage;

supplying the data voltage to the plurality of pixels, the pixels comprising a red pixel, a green pixel and a blue pixel; and determining and supplying a different source voltage according to a gamma curve to the red pixel, the green pixel and the blue pixel through a level shift unit, in order to control a drain-gate voltage of a driving transistor of the red, green and blue pixels wherein supplying the different source voltage comprises supplying a first source voltage to the red pixel; supplying a second source voltage to the green pixel; and supplying a third source voltage to the blue pixel, thereby controlling the gamma curve without a unit to generate a gamma voltage.

7. A driving system for an electro-luminescence display device, comprising:

an organic light emitting diode (OLED) panel comprising a plurality of pixels, the pixels comprising a red pixel, a green pixel and a blue pixel, wherein each pixel comprises a driving transistor and a different source voltage is supplied to a drain terminal of the driving transistor and the data voltage is supplied to a gate terminal of the driving transistor;

a controller receiving a first digital data and converting the first digital data to a second digital data for a gray scale display, wherein the controller comprises a single look up table applied to the first digital data and storing a plurality of index values, and a scan control unit receives the first digital data signal and provides a control signal to a scan driver, wherein the first digital data comprises a red data signal, a green data signal and a blue data signal, and the single look up table is configured to match each index value to each of the first digital data, independent of each of the first digital data being the red, green, or blue data signal, such that the red, green and blue data signals having an identical bit stream are converted to an identical index value, and wherein the first digital data comprises an n bit and the second digital data comprises an m bit, m being greater than n, and wherein the scan driver activates the plurality of pixels in sequence, and activates the plurality of pixels to light on and light off;

a frame memory unit receiving the second digital data from the controller and storing the second digital data; and a level shift unit converting the second digital signal to a data voltage and supplying the data voltage to the pixels, the level shift unit operable to determine and provide a different source voltage according to a gamma curve to the red pixel, the green pixel and the blue pixel, respectively, thereby controlling the gamma curve without a unit to generate a gamma voltage.

* * * * *